US009330601B2

(12) United States Patent
Lee et al.

(10) Patent No.: US 9,330,601 B2
(45) Date of Patent: May 3, 2016

(54) DISPLAY DEVICE AND METHOD FOR DRIVING THE SAME

(71) Applicant: SAMSUNG DISPLAY CO., LTD., Yongin-si, Gyeonggi-Do (KR)

(72) Inventors: Seung-Kyu Lee, Asan-si (KR); Jin Jeon, Seoul (KR); Ki-Myeong Eom, Suwon-si (KR); Ji-Hye Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/446,121

(22) Filed: Jul. 29, 2014

(65) Prior Publication Data

US 2015/0187270 A1 Jul. 2, 2015

(30) Foreign Application Priority Data

Dec. 27, 2013 (KR) ..... 10-2013-0165538

(51) Int. Cl.
*G09G 3/30* (2006.01)
*G09G 3/32* (2016.01)

(52) U.S. Cl.
CPC ..... *G09G 3/3258* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0254* (2013.01); *G09G 2320/045* (2013.01); *G09G 2330/028* (2013.01); *G09G 2360/08* (2013.01)

(58) Field of Classification Search
CPC ..... G09G 2330/028; G09G 2360/08; G09G 3/3258; G09G 3/3266
USPC ..... 345/211–214, 76
See application file for complete search history.

(56) References Cited

U.S. PATENT DOCUMENTS

2007/0296651 A1 12/2007 Kim et al.
2011/0122119 A1* 5/2011 Bae ..... G09G 3/3233 345/211
2012/0001896 A1* 1/2012 Han ..... G09G 3/3233 345/214
2013/0002632 A1 1/2013 Choi

FOREIGN PATENT DOCUMENTS

KR 10-2008-0000294 A 1/2008
KR 10-2009-0072885 A 7/2009
KR 10-2012-0008085 A 1/2012
KR 10-2013-0007214 A 1/2013

* cited by examiner

*Primary Examiner* — Quan-Zhen Wang
*Assistant Examiner* — Tony Davis
(74) *Attorney, Agent, or Firm* — Lewis Roca Rothgerber Christie LLP

(57) ABSTRACT

A method of driving a display device includes: applying a first voltage at the first transistor to turn on the first transistor; maintaining the first voltage at the first transistor; applying a second voltage lower than the first voltage at the first transistor; wherein the applying of the first voltage comprises switching the fourth transistor according to the second scan signal to couple the gate electrode of the first transistor to the third power source, and switching the fifth transistor according to the light emission control signal to couple the first electrode of the first transistor to the first power source, and the applying of the second voltage comprises switching the second transistor according to the first scan signal to couple the first electrode of the first transistor to the data line, and switching the third transistor according to the first scan signal to diode-couple the first transistor.

10 Claims, 12 Drawing Sheets

DISPLAY DEVICE AND METHOD FOR DRIVING THE SAME

CROSS-REFERENCE TO RELATED APPLICATION

This application claims priority to and the benefit of Korean Patent Application No. 10-2013-0165538, filed on Dec. 27, 2013, with the Korean Intellectual Property Office, the disclosure of which is incorporated herein in its entirety by reference.

BACKGROUND

1. Field

Embodiments of the present invention relate to a display device and a method for driving the same.

2. Description of the Related Art

Various types of flat panel displays (FPDs) that have reduced weight and volume compared to a cathode ray tube (CRT) are currently being developed. The FPDs include liquid crystal displays (LCDs), field emission displays (FEDs), plasma display panels (PDPs), organic light emitting diode (OLED) displays, and the like.

Among the FPDs, the OLED display displays images using organic light emitting diodes (OLEDs) that generate light by recombining electrons and holes, and it is drawing attention owing to aspect such as short response time, low power consumption, high luminous efficiency, improved luminance and viewing angle.

The OLED display can be generally classified into two types according to the driving method of the OLED: a passive-matrix OLED (PMOLED) and an active-matrix OLED (AMOLED).

Of the two types, the active-matrix OLED, in which unit pixels are selectively lit in terms of resolution, contrast, and operation speed, is primarily used.

One pixel of the active-matrix OLED includes an OLED, a first transistor for controlling an amount of current applied to the OLED, and a switching transistor for transmitting a data signal to the first transistor to control an amount of light emitted by the OLED.

Recently, research on a compensation circuit has been carried out to compensate for a threshold voltage variation of the first transistor included in the pixel of the active-matrix OLED. However, in the case where the compensation circuit is used to display a target luminance, the response time varies depending on increases or decreases of data voltage due to hysteresis such that it is difficult to correctly display gray levels. For example, the response time may be delayed when the OLED display is driven to display luminance from black to white, and this problem may cause sticking when a text is scrolled on a screen.

In order to decrease (e.g., improve) the response time, a driving method of applying on-bias voltage to the first transistor before an initialization period has been suggested. However, a characteristic curve of the first transistor changes when the on-bias voltage is applied, thereby causing smear on the screen when the gray levels are displayed.

Therefore, a pixel circuit is desired to compensate for the threshold voltage variation of the first transistor included in the pixel, and mitigate (e.g., solve) the change of the response time due to the hysteresis and reduce the smear resulting from the on-bias voltage application.

SUMMARY

Aspects of embodiments of the present invention are directed to a display device and a driving method thereof.

Further, aspects of embodiments of the present invention are directed to a high-quality and high-definition display device in which gray levels are correctly displayed by mitigating (e.g., solving) a problem of response time caused by hysteresis, reducing (e.g., eliminating) sticking on a screen, compensating for a threshold voltage variation of a first transistor, and decreasing (e.g., removing) smear on a screen resulting from an on-bias voltage application, and a method of driving the display device.

According to one embodiment of the present invention, a method of driving a display device including a plurality of pixels, wherein each of the plurality of pixels includes: an organic light emitting diode (OLED) between a first power source and a second power source; a first transistor configured to transmit a driving current corresponding to a data signal to the OLED; a second transistor configured to couple one electrode of the first transistor to a data line in response to a first scan signal; a third transistor configured to diode-couple the first transistor in response to the first scan signal; a fourth transistor configured to transmit voltage of a third power source to a gate electrode of the first transistor in response to a second scan signal; a fifth transistor configured to control light emission of the OLED in response to a light emission control signal; and a capacitor between the first power source and the first transistor, includes: applying a first voltage at the first transistor to turn on the first transistor; maintaining the first voltage at the first transistor; applying a second voltage lower than the first voltage at the first transistor; and maintaining the second voltage at the first transistor, wherein the applying of the first voltage includes switching the fourth transistor according to the second scan signal to couple the gate electrode of the first transistor to the third power source, and switching the fifth transistor according to the light emission control signal to couple the first electrode of the first transistor to the first power source, and the applying of the second voltage includes switching the second transistor according to the first scan signal to couple the first electrode of the first transistor to the data line, and switching the third transistor according to the first scan signal to diode-couple the first transistor.

The first scan signal may be transmitted to a first scan line, and the second scan signal may be transmitted to a second scan line prior to the transmission of the first scan signal.

The maintaining of the first and second voltages may float the first electrode of the first transistor.

The applying of the second voltage and the maintaining of the second voltage may be performed at least twice consecutively.

The display device may further include a seventh transistor between the OLED and the third power source, wherein the gate electrode of the seventh transistor is coupled to the second scan line and the seventh transistor is turned on during the applying of the first voltage and the maintaining of the first voltage.

The display device may further include a sixth transistor configured to control light emission of the OLED.

The method may further include: initializing a gate electrode voltage of the first transistor; compensating for a threshold voltage of the first transistor and transmitting the data signal to the first transistor through the data line coupled to the first transistor; and providing the driving current to the OLED according to the data signal to produce light emission.

The initializing of the gate electrode voltage of the first transistor may include switching the fourth transistor according to the second scan signal to supply voltage of the third power source to the gate electrode of the first transistor.

The compensating for the threshold voltage of the first transistor and the transmitting of the data signal to the first transistor may include switching the second transistor according to the first scan signal to couple the first transistor and the data line, and switching the third transistor according to the first scan signal to diode couple the first transistor.

The providing of the driving current to the OLED according to the data signal to produce light emission may include controlling the light emission of the OLED by the fifth transistor between the first power source and the OLED and is operated by the light emission control signal.

According to another embodiment of the present invention, a method of driving a display device including a plurality of pixels, wherein each of the plurality of pixels includes: an OLED between a first power source and a second power source; a first transistor between the first power source and the OLED, a gate electrode of the first transistor being coupled to a first node; a second transistor between a first electrode of the first transistor coupled to the first power source and a data line, the gate electrode of the second transistor being coupled to a first scan line; a third transistor between a second electrode of the first transistor coupled to the OLED and the first node, the gate electrode of the third transistor being coupled to the first scan line; a fourth transistor between a third power source and the first node, the gate electrode of the fourth transistor being coupled to a second scan line; a fifth transistor between the first power source and the OLED, the gate electrode of the fifth transistor being coupled to a light emission control line; and a capacitor between the first power source and the first node, includes: applying a first voltage at the first transistor to turn on the first transistor; maintaining the first voltage at the first transistor; applying a second voltage lower than the first voltage at the first transistor; and maintaining the second voltage at the first transistor, wherein the applying of the first voltage includes switching the fourth transistor according to a second scan signal to couple the gate electrode of the first transistor to the third power source, and switching the fifth transistor according to a light emission control signal to couple the first electrode of the first transistor to the first power source, and the applying of the second voltage includes switching the second transistor according to a first scan signal to couple the first electrode of the first transistor to the data line, and switching the third transistor according to the first scan signal to diode-couple the first transistor.

According to embodiments of the present invention, the display device may reduce (e.g., prevent) a delay of response time caused by hysteresis and decrease (e.g., eliminate) sticking on a screen so as to display correct gray levels.

Further, according to embodiments of the present invention, the display device may compensate for the threshold voltage variation of the first transistor and may reduce (e.g., eliminate) the smear on the screen resulting from the on-bias voltage applied to the first transistor so as to be realized to have high quality and high definition.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present invention will be more clearly understood from the following detailed description, taken in conjunction with the accompanying drawings, in which.

DETAILED DESCRIPTION

Figure 1:
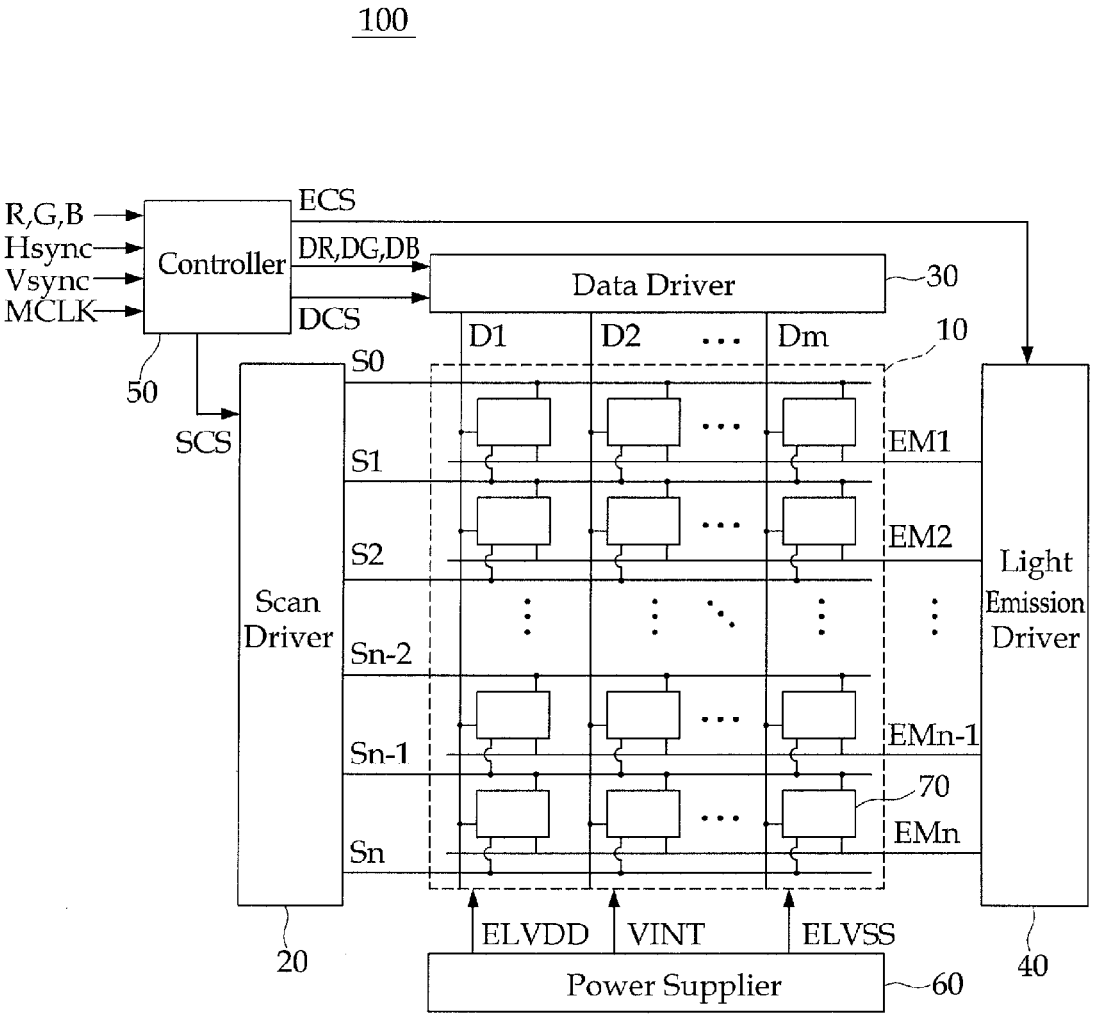
FIG. 1 is a schematic block diagram illustrating a display device according to an embodiment of the present invention.

Aspects and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the present invention to those skilled in the art. The present invention is merely defined by the scope of the claims, and equivalents thereof. Therefore, well-known constituent elements, operations and techniques are not described in detail in the embodiments in order to prevent the present invention from being obscurely interpreted. Like reference numerals refer to like elements throughout the specification.

The spatially relative terms "below", "beneath", "lower", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

The terminology used herein is for the purpose of describing particular embodiments only and is not construed as limiting the present invention. As used herein, the singular forms "a," "an" and "the" are intended to include the plural forms as well, unless the context clearly indicates otherwise. It will be further understood that the terms "comprises" and/or "comprising," when used in this specification, specify the presence of mentioned component, step, operation and/or element, but do not exclude the presence or addition of one or more other components, steps, operations and/or elements.

Unless otherwise defined, all terms used herein (including technical and scientific terms) have the same meaning as commonly understood by those skilled in the art to which the present invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Hereinafter, a method of driving a display device according to an embodiment of the present invention will be described in detail with reference to FIGS. 1 to 5.

FIG. 1 is a schematic block diagram illustrating a display device according to an embodiment of the present invention.

Referring to FIG. 1, according to an embodiment of the present invention, the display device 100 includes a display unit 10 including a plurality of pixels, a scan driver 20, a data driver 30, a light emission driver 40, a controller 50, and a power supply unit (or power supplier) 60 configured to supply external voltage to the display device 100.

Each of the plurality of pixels is coupled to two scan lines of a plurality of scan lines S0 to Sn in the display unit 10.

The pixel of FIG. 1 is coupled to a scan line corresponding to a pertinent pixel line, and a scan line of its previous pixel line, but this is not limited thereto.

Further, each of the plurality of pixels is coupled to one data line among a plurality of data lines D1 to Dm configured to transmit data signals to the display unit 10, and one light emission control line among a plurality of light emission control lines EM1 to EMn configured to transmit emission control signals to the display unit 10.

The scan driver 20 is configured to generate and transmit two corresponding scan signals to each pixel through the plurality of scan lines S0 to Sn. That is, the scan driver 20 is configured to transmit the first scan signal through the scan line corresponding to the pixel line including the pixels, and transmit the second scan signal through the scan line corresponding to the previous pixel line.

Referring to FIG. 1, one pixel 70 among a plurality of pixels included in the $n^{th}$ pixel line is coupled to the scan line Sn corresponding to the $n^{th}$ pixel line and the scan line Sn−1 corresponding to the $(n-1)^{th}$ pixel line.

The pixel 70 receives the first scan signal through the scan line Sn, and concurrently receives the second scan signal through the scan line Sn−1.

The data driver 30 is configured to transmit a data signal to each pixel through the plurality of data lines D1 to Dm.

The light emission driver 40 is configured to generate and transmit a light emission control signal to each pixel through the plurality of light emission control lines EM1 to EMn.

The controller 50 is configured to convert a plurality of video signals R, G, and B transmitted from an external source into a plurality of respective image data signals DR, DG, and DB so as to transmit them to the data driver 30. Further, the controller 50 receives a vertical synchronization signal Vsync, a horizontal synchronization signal Hsync, and a clock signal MCLK so as to generate control signals for driving control of the scan driver 20, the data driver 30, and the light emission driver 40, and transmit the control signals. That is, the controller 50 is configured to generate and transmit a scan driving control signal SCS for controlling the scan driver 20, a data driving control signal DCS for controlling the data driver 30, and a light emission driving control signal ECS for controlling the light emission driver 40.

The display unit 10 includes a plurality of pixels, and the pixels are at respective crossings of the plurality of scan lines S0 to Sn, the plurality of data lines D1 to Dm, and the plurality of light emission control lines EM1 to EMn.

The plurality of pixels are supplied or applied with external voltages such as a first power source voltage ELVDD, a second power source voltage ELVSS, and a third power source voltage VINT from the power supply unit 60. The first power source voltage ELVDD may have a higher voltage level than that of the second power source voltage ELVSS. The third power source voltage VINT may be an initialization voltage for initializing a voltage of a gate electrode of a first transistor. The first power source voltage ELVDD may have a voltage of about 3 V to about 6 V, and the second power source voltage ELVSS may have a voltage of about −7 V to about 0 V. The voltage ranges of the first and second power source voltages ELVDD and ELVSS are merely an example, and the first and second power source voltages ELVDD and ELVSS may be in various ranges to suitably drive the display device 100.

The display unit 10 includes a plurality of pixels substantially arranged in a matrix form. Although not particularly limited, the plurality of scan lines S0 to Sn extend generally in a row direction in the pixel arrangement so as to be substantially parallel to each other, and the plurality of data lines D1 to Dm extend generally in a column direction so as to be substantially parallel to each other in the arrangement of the pixels.

Each of the plurality of pixels emits light having a set luminance (e.g., a predetermined luminance) by a driving current applied to an organic light emitting diode (OLED) according to a corresponding data signal transmitted through the plurality of data lines D1 to Dm.

Hereinafter, according to an embodiment of the present invention, a circuit configuration of the pixel 70 of the display device 100 will be described in detail with reference to FIG. 2.

Figure 2:
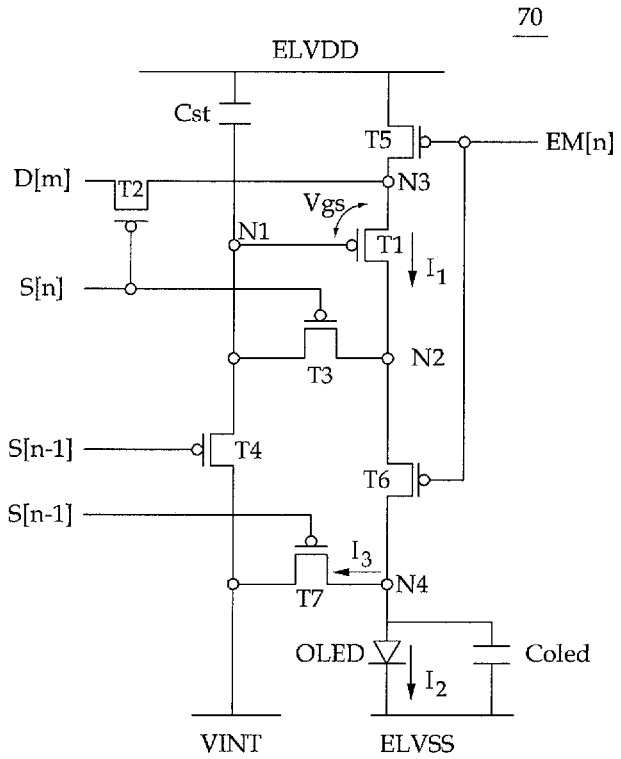
FIG. 2 is a circuit diagram illustrating a pixel circuit configuration of the display device shown in FIG. 1.

FIG. 2 is a circuit diagram illustrating a pixel circuit configuration of the display device shown in FIG. 1.

Referring to FIG. 2, the pixel 70 is coupled to the $n^{th}$ scan line Sn and the $(n-1)^{th}$ scan line Sn−1 among the plurality of pixels included in the display unit 10 of the display device 100 of FIG. 1. Also, the pixel 70 is coupled to the $m^{th}$ data line Dm and the $n^{th}$ light emission control line EMn. For ease of description, the scan line Sn is called a first scan line, and the scan line Sn−1 is called a second scan line.

The pixel 70 is coupled to the first scan line configured to transmit a first scan signal to activate the pixel 70 to transmit a data signal, and the second scan line configured to transmit a second scan signal to apply an initialization voltage VINT to a first transistor T1 and to control the first transistor T1 to be maintained with the operation voltage (e.g., on-bias voltage) or threshold voltage Vth.

Each transistor includes a gate electrode, a first electrode, and a second electrode. The first electrode may be a source electrode, and the second electrode may be a drain electrode. Hereinafter, for ease of description, the first electrode will be written as the source electrode, and the second electrode will be written as the drain electrode.

The pixel 70 shown in FIG. 2 includes an OLED, a first transistor T1, a second transistor T2, a third transistor T3, a fourth transistor T4, a fifth transistor T5, a sixth transistor T6, a seventh transistor T7, and a capacitor Cst.

The first transistor T1 includes a gate electrode coupled to a first node N1, a source electrode coupled to a third node N3 coupled to a drain electrode of the fifth transistor T5, and a drain electrode coupled to a second node N2.

The first transistor T1 is configured to generate a driving current I1 of a data voltage according to a corresponding data signal D[m] applied to the third node N3 coupled to the source electrode of the first transistor T1 through the $m^{th}$ data line Dm and the second transistor T2, and to transmit the driving current I1 to the OLED through the drain electrode. The driving current I1 is a current corresponding to a voltage difference Vgs between the source electrode and the gate electrode of the first transistor T1, and it may change in response to the data voltage corresponding to the data signal applied to the source electrode.

Hereinafter, for ease of description, the voltage difference between the source electrode and the gate electrode of the first transistor T1 will be written as gate-source voltage. In the case where the gate-source voltage Vgs turns on the first transistor T1, it may be called the on-bias voltage, and in the case where the gate-source voltage Vgs is lower than the threshold voltage of the first transistor T1 so as to turn off the first transistor T1, it may be called the off-bias voltage.

The second transistor T2 includes a gate electrode coupled to the $n^{th}$ scan line Sn, a source electrode coupled to the $m^{th}$ data line Dm, and a drain electrode coupled to the third node N3 coupled to the source electrode of the first transistor T1 and a drain electrode of the fifth transistor T5 in common.

The second transistor T2 is configured to activate driving of the pixel 70 in response to the corresponding scan signal S[n] transmitted through the $n^{th}$ scan line Sn. In other words, the second transistor T2 is configured to transmit the data voltage corresponding to the data signal D[m] transmitted through the $m^{th}$ data line Dm to the third node N3 in response to the scan signal S[n].

The third transistor T3 includes a gate electrode coupled to the $n^{th}$ scan line Sn and both electrodes respectively coupled to the gate electrode and drain electrode of the first transistor T1.

The third transistor T3 operates in response to the corresponding scan signal S[n] transmitted through the $n^{th}$ scan line Sn, and couples the gate electrode and drain electrode of the first transistor T1 together so as to diode couple the first transistor T1, thereby compensating for the threshold voltage of the first transistor T1.

That is, in the case where the first transistor T1 is diode-coupled, the voltage reduced from the data voltage applied to the source electrode of the first transistor T1 by the threshold voltage of the first transistor T1 is applied to the gate electrode of the first transistor T1.

For ease of description, the threshold voltage of the first transistor T1 is Vth, the data voltage applied to the source electrode of the first transistor T1 is Vdata, and the voltage applied to the gate electrode of the first transistor T1 by the diode coupling is Vdata−Vth (i.e., Vdata minus Vth).

The gate electrode of the first transistor T1 is coupled to one electrode of the capacitor Cst, and thus the voltage Vdata-Vth is maintained by the capacitor Cst. The voltage Vdata-Vth reflecting the threshold voltage Vth of the first transistor T1 is applied to the gate electrode and is then maintained, and the driving current I1 flowing into the first transistor T1 is not affected by the threshold voltage Vth of the first transistor T1.

The fifth transistor T5 includes a gate electrode coupled to the $n^{th}$ light emission control line EMn, a source electrode coupled to a supply line of the first power source voltage ELVDD, and a drain electrode coupled to the third node N3.

The sixth transistor T6 includes a gate electrode coupled to the $n^{th}$ light emission control line EMn, a source electrode coupled to the second node N2, and a drain electrode coupled to a fourth node N4 coupled to an anode of the OLED.

The fifth and sixth transistors T5 and T6 operate in response to the $n^{th}$ light emission control signal EM[n] transmitted through the $n^{th}$ light emission control line EMn. That is, when the fifth and sixth transistors T5 and T6 are turned on in response to the $n^{th}$ light emission control signal EM[n], a current path is formed to allow the driving current I1 to flow toward the OLED from the first power source voltage ELVDD. Consequently, the OLED may emit light according to a light emission current I2 corresponding to the driving current I1 so that an image of the data signal may be displayed.

The fourth transistor T4 includes a gate electrode coupled to the $(n-1)^{th}$ scan line Sn−1, a source electrode coupled to a supply line of the initialization voltage VINT, and a drain electrode coupled to the first node N1 coupled to the gate electrode of the first transistor T1 and one electrode of the third transistor T3 in common.

The fourth transistor T4 is configured to transmit the initialization voltage VINT applied through the supply line of the initialization voltage VINT to the first node N1 in response to the $(n-1)^{th}$ scan signal S[n−1] transmitted through the $(n-1)^{th}$ scan line Sn−1.

The fourth transistor T4 may transmit the third power source voltage VINT as an initialization voltage to the first node N1, before the pixel driver is activated, in response to the $(n-1)^{th}$ scan signal S[n−1] transmitted in advance to the $(n-1)^{th}$ scan line Sn−1 corresponding to the previous pixel row of the $n^{th}$ pixel row including the pixel 70.

In this case, the third power source voltage VINT is not limited, but it may be determined to have a low voltage level so as to initialize the voltage of the gate electrode of the first transistor T1 to be sufficiently low. The gate electrode of the first transistor T1 is initialized to be the third power source voltage (initialization voltage) VINT during a period when the $(n-1)^{th}$ scan signal S[n−1] is transmitted to the gate electrode of the fourth transistor T4 at a gate-on voltage level. For instance, the initialization voltage may be in a range of about −5 V to about 0 V.

The capacitor Cst includes one electrode coupled to the first node N1, and the other electrode coupled to the supply line of the first power source voltage ELVDD. As described above, the capacitor Cst is coupled between the gate electrode of the first transistor T1 and the supply line of the first power source voltage ELVDD, and thus it may maintain the voltage applied to the gate electrode of the first transistor T1.

The seventh transistor T7 includes a source electrode coupled to the fourth node N4 to which the drain electrode of the sixth transistor T6 and the anode of the OLED are coupled, a gate electrode coupled to the $(n-1)^{th}$ scan line Sn−1, together with the gate electrode of the fourth transistor T4, and a drain electrode coupled to the power supply line of the third power source voltage VINT.

A bypass current I3 flows through the seventh transistor T7 by the voltage (e.g., the predetermined voltage) of the third power source voltage VINT while the seventh transistor T7 is turned off. In this case, the voltage (e.g., the predetermined voltage) of the third power source voltage VINT is not particularly limited, and for example, it may be equal to or lower than the second power source voltage ELVSS that is a cathode voltage of the OLED. In the case where the minimum current of a transistor for displaying a black image flows as a driving current I1 and the OLED emits light, the black image is not correctly displayed and the minimum current of the transistor as the bypass current I3 may be partially diverted (e.g., divided) to a different path from the current path of the OLED. Herein, the minimum current of the transistor denotes a current in the case where the gate-source voltage of the transistor is lower than the threshold voltage and the transistor is turned off. The minimum driving current (e.g., a current equal to or less than 10 pA) under the condition that the transistor is turned off is transmitted to the OLED and is then displayed as an image with black luminance.

In the case where the minimum driving current for displaying the black image flows, the influence caused by bypassing the bypass current I3 is great, and in the case where a high driving current for displaying a general image or a white image flows, there is little influence of the bypass current I3. Therefore, in the case where the driving current for displaying the black image flows, the light emission current I2 of the OLED, which has a reduced current amount due to the bypass current I3 that is diverted (e.g., bypassed) from the driving current I1, has a for accurately displaying the black image.

Hereinafter, a pixel drive operation based on a timing diagram shown in FIG. 3 will be described in detail. The first scan line refers to the current scan line, and the second scan line refers to the previous scan line.

Figure 3:
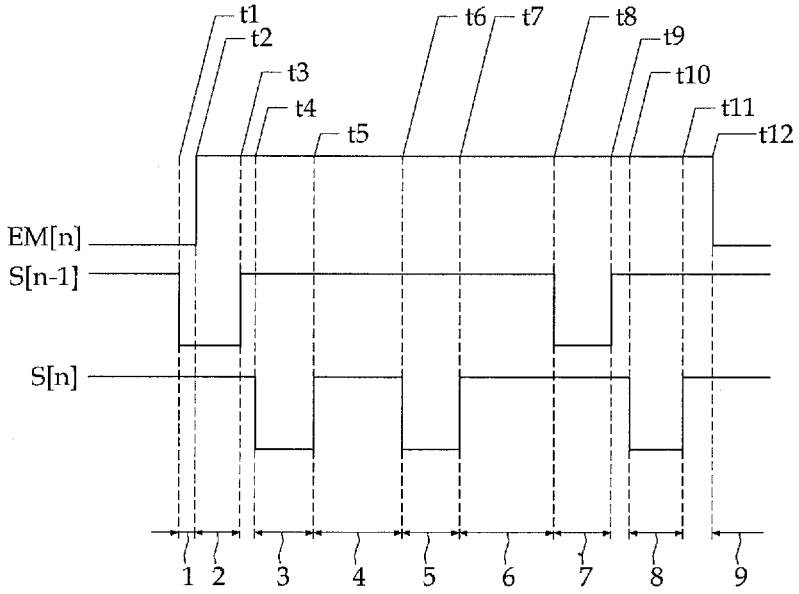
FIG. 3 is a timing diagram illustrating a driving operation of the pixel circuit shown in FIG. 2.

FIG. 3 is a timing diagram showing a drive operation of the pixel shown in FIG. 2.

Referring to FIG. 3, the second scan signal and the first scan signal are sequentially applied to the second scan line Sn−1 and the first scan line Sn, respectively.

The second scan signal may be applied twice, and is set to be a voltage (e.g. a low voltage) allowing the fourth transistor T4 and the seventh transistor T7 shown in FIG. 2 to be turned on.

The first scan signal may be applied at least twice, and is set to be a voltage (e.g. a low voltage) allowing the second transistor T2 and the third transistor T3 shown in FIG. 2 to be turned on.

The light emission control signal applied to the light emission control line En is set to be a voltage (e.g. a low voltage) allowing the fifth transistor T5 and the sixth transistor T6 shown in FIG. 2 to be turned on during the first period 1 in which the second scan signal is applied. Further, the light emission control signal is set to be a voltage (e.g. a high voltage) allowing the fifth transistor T5 and the sixth transistor T6 to be turned off during the second period 2 to the eighth period 8, and thereafter is reset to be a voltage allowing the fifth transistor T5 and the sixth transistor T6 to be turned on during the light emission period after the supply of the first scan signal is completed, namely, during the ninth period 9.

In other words, the supply of the light emission control signal set to the high voltage that turns off the fifth transistor T5 and the sixth transistor T6 is initiated during the second period 2 in which the second scan signal is applied, and is maintained until the supply of the second scan signal is completed.

An operation process of the pixel driven by the driving signals shown in FIG. 3 will be described below in detail with reference to FIGS. 4A to 4I.

FIGS. 4A, 4B, 4C, 4D, 4E, 4F, 4G, 4H and 4I are circuit diagrams and timing diagrams sequentially illustrating a driving method of the pixel shown in FIG. 2 driven according to the timing diagram shown in FIG. 3.

Figure 4A:
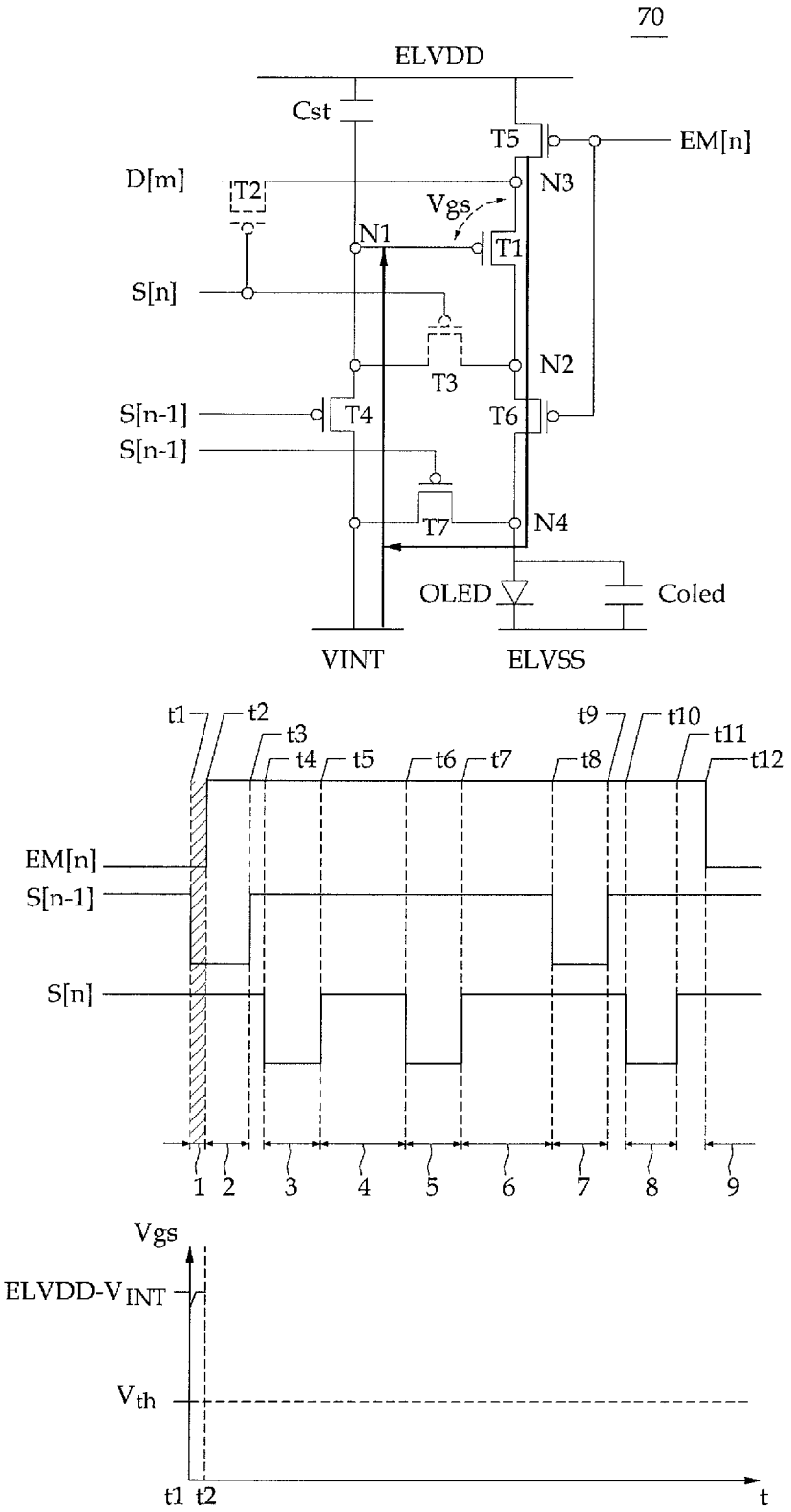
FIGS. 4A, 4B, 4C, 4D, 4E, 4F, 4G, 4H and 4I are circuit diagrams and timing diagrams sequentially illustrating a driving method of the pixel shown in FIG. 2 driven according to the timing diagram shown in FIG. 3.

Referring to FIG. 4A, the light emission control signal set to the low voltage is applied from the light emission control line En during the first period 1 in which the second scan signal is applied to the second scan line Sn−1.

In the case where the second scan signal having the low voltage is applied to the second scan line Sn−1, the fourth transistor T4 is turned on such that the third power source voltage VINT is transmitted to the first node N1 (the arrow direction of FIG. 4A is illustrated by considering that the voltage of the first node N1 may be set to be equal to or less than the third power source voltage VINT before the first period 1).

Herein, the third power source voltage VINT may be set to be low enough to initialize the first node N1. For example, the third power source voltage VINT may range from about −5 V to about 0 V.

As described above, the third power source voltage VINT is set to the low voltage, and the first transistor T1 is also turned on during the first period 1 in which the second scan signal is applied to the second scan line Sn−1.

In the case where the light emission control signal set to the low voltage is supplied from the light emission control line En, the fifth and sixth transistors T5 and T6 are turned on.

Consequently, during the first period 1, the third power source voltage VINT is applied to the first node N1, and also a current path to the third power source voltage VINT via the fifth transistor T5, the first transistor T1, the sixth transistor T6, and the seventh transistor T7 from the first power source voltage ELVDD is formed.

Accordingly, current (e.g., a predetermined current) flows into the first transistor T1 so that the hysteresis of the first transistor T1 is compensated, and also the current flows through to the seventh transistor T7 from the sixth transistor T6 so that the OLED is prevented from emitting light, thereby reducing (e.g., preventing) increase of the black luminance.

In other words, the first period 1 is a response time improvement period for shortening the response time by reducing (e.g., preventing) increase of the response time resulting from the hysteresis of the first transistor T1 by having the current (e.g., the predetermined current) flow into the first transistor T1. There is an aspect that the black is clearly displayed by reducing (e.g., preventing) the emission of light of the OLED during the above-mentioned period.

Further, the on-bias voltage Vgs is formed between the gate and source electrodes of the first transistor T1 during the first period 1. In detail, the gate-source voltage Vgs of the first transistor T1 is formed by the third power source voltage VINT applied to the gate electrode of the first transistor T1 and the first power source voltage ELVDD applied to the source electrode of the first transistor T1 during the first period 1. For instance, the gate-source voltage Vgs may range from about −10 V to about −5 V, and the first power source voltage ELVDD may range from about 3 V to about 6 V.

The graph of the gate-source voltage Vgs, shown in FIG. 4A, indicates that the gate-source voltage Vgs increases at t1, and a voltage difference value is formed between the first power source voltage ELVDD and the third power source voltage VINT at t2. In other words, the gate-source voltage Vgs of the first transistor T1 is a difference voltage ELVDD-VINT between the first power source voltage ELVDD and the third power source voltage VINT during the first period 1.

Specific voltage at t1 is the gate-source voltage Vgs formed before the first period 1. The gate-source voltage Vgs formed before the first period 1 is assumed to be slightly lower than the gate-source voltage Vgs to be formed during the first period 1, and thus the graph of the gate-source voltage Vgs may be shown in a different way from that shown in FIG. 4A.

Figure 4B:
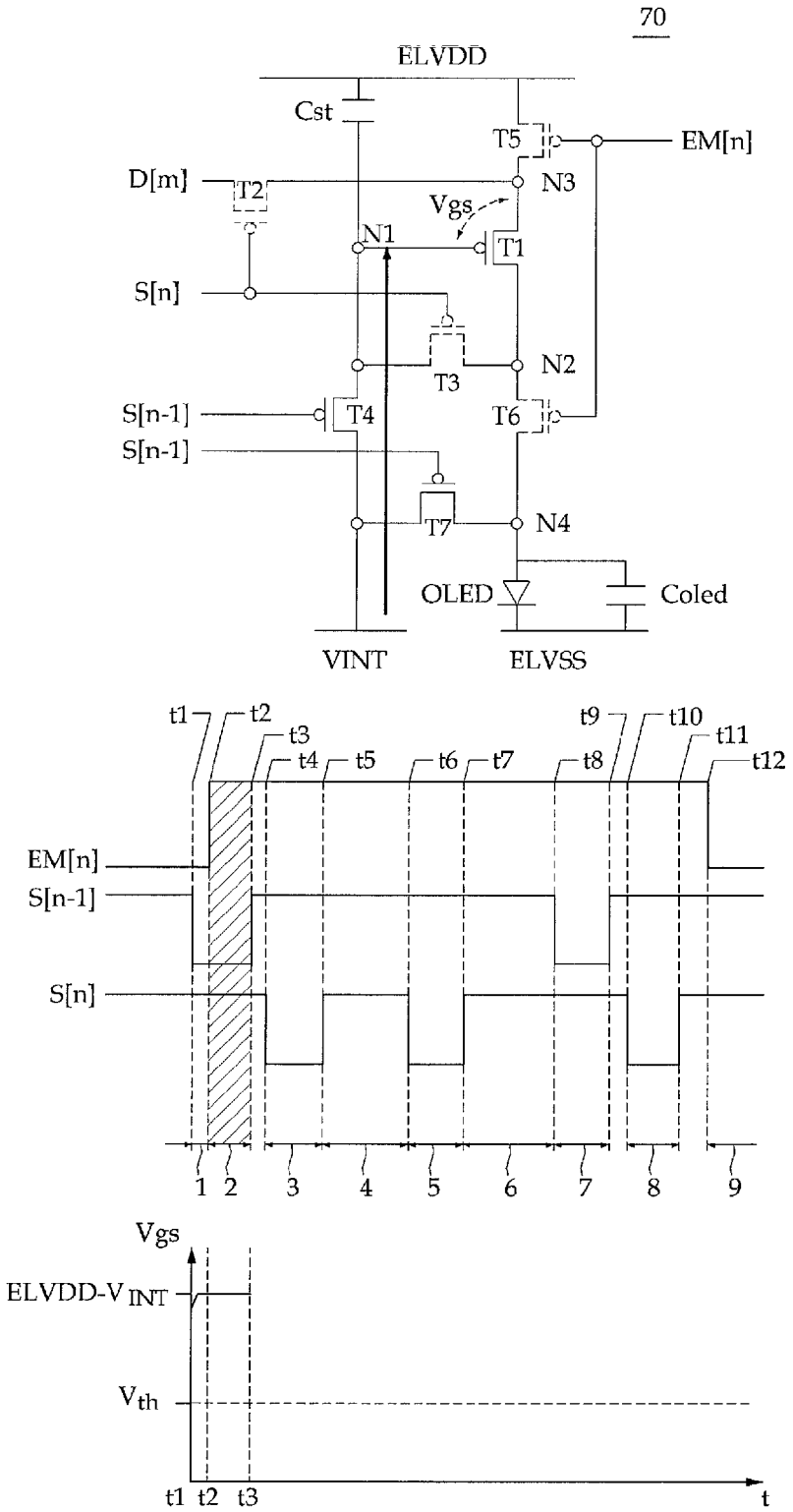

As illustrated in FIG. 4B, the voltage of the light emission control signal applied to the light emission control line En is changed to the high voltage during the second period 2.

That is, during the second period 2, the supply of the second scan signal having the low voltage is maintained in the second scan line Sn−1, and also the light emission control signal having the high voltage is applied to the light emission control line En.

In the case where the light emission control signal having the high voltage is applied to the light emission control line En, the fifth and sixth transistors T5 and T6 are turned off, and then the current flowing via the first transistor T1 is blocked during the second period 2.

The second scan signal having the low voltage is also maintained to be applied during the second period 2 as in the first period 1, and thus the fourth transistor T4 is maintained in a turn-on state, so that the first node N1 is stably supplied with the third power source voltage VINT.

The third power source voltage VINT, which is the same as that of the first period 1, may be also applied to the first node N1 during the second period 2, and the source electrode of the first transistor T1 is floating. Therefore, as shown in the graph of FIG. 4B, the gate-source voltage Vgs of the first transistor T1 is the same as the voltage at t2, which is formed during the first period 1, and is maintained from t2 to t4. In other words, the on-bias voltage Vgs between the gate and source electrodes of the first transistor T1 is formed during the second period 2.

Figure 4C:
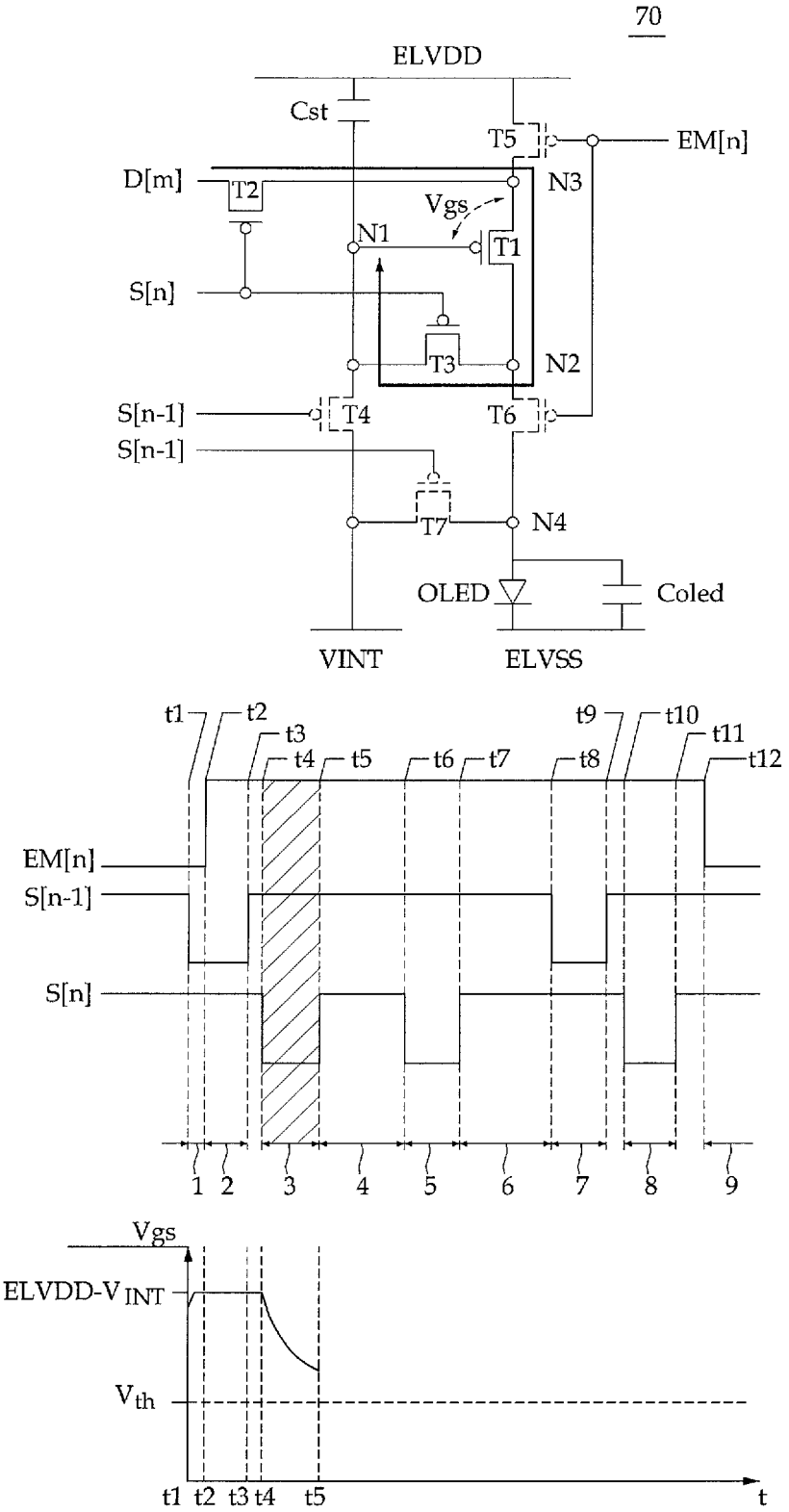

As shown in FIG. 4C, the first scan signal having the low voltage is applied to the first scan line Sn during a third period 3.

Then, the second and third transistors T2 and T3 are turned on, and the first transistor T1 is diode coupled by the third transistor T3.

During the third period 3, a first data signal is applied to the data line Dm, and the first data signal is transmitted to the first node N1 via the second transistor T2, the first transistor T1, and the third transistor T3. In this configuration, the first transistor T1 is in the diode-coupled state, so that the different voltage between a first data voltage applied by the first data signal and the threshold voltage Vth of the first transistor T1 is applied to the first node N1. The voltage transmitted to the first node N1 during the third period 3 is stored in the capacitor Cst.

The first data voltage applied by the first data signal is not a present data voltage but a previous data voltage. The previous data voltage may be a data voltage immediately before the present data voltage, or a data voltage prior to the four lines. That is, the data voltage enables the gate-source voltage Vgs of the first transistor T1 to be lowered near the threshold voltage Vth. Therefore, the third period 3 is not a present data programming period, but a period in which the gate-source voltage Vgs formed during the first and second periods 1 and 2 is lowered near the threshold voltage Vth of the first transistor T1.

Referring to the graph of FIG. 4C, the gate-source voltage Vgs formed during the first and second periods 1 and 2 is lowered near the threshold voltage Vth of the first transistor T1 between t4 and t5. That is, the on-bias voltage Vgs between the gate and source electrodes of the first transistor T1 is formed during the third period 3.

Figure 4D:
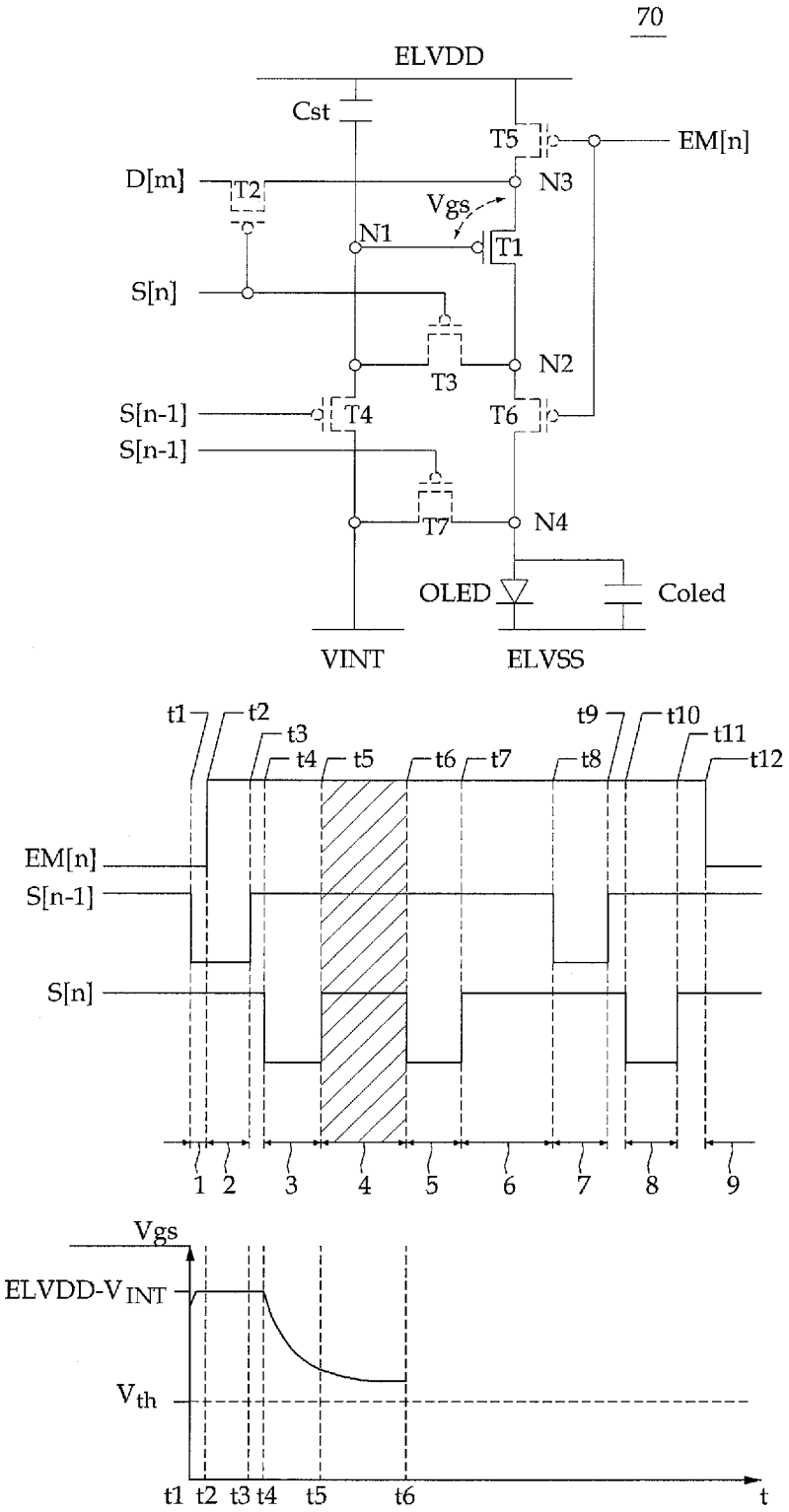

As shown in FIG. 4D, the scan signal having the high voltage is applied to the first and second scan lines Sn during a fourth period 4 so that all of the transistors T2 to T7 are turned off except for the first transistor T1.

The gate and source electrodes of the first transistor T1 are floating during the fourth period 4. Thus, referring to the graph of FIG. 4D, the gate-source voltage Vgs of the first transistor T1 is maintained as the voltage formed during the third period 3 from t5 to t6. In other words, the on-bias voltage Vgs between the gate and source electrodes of the first transistor T1 is formed during the fourth period 4.

Figure 4E:
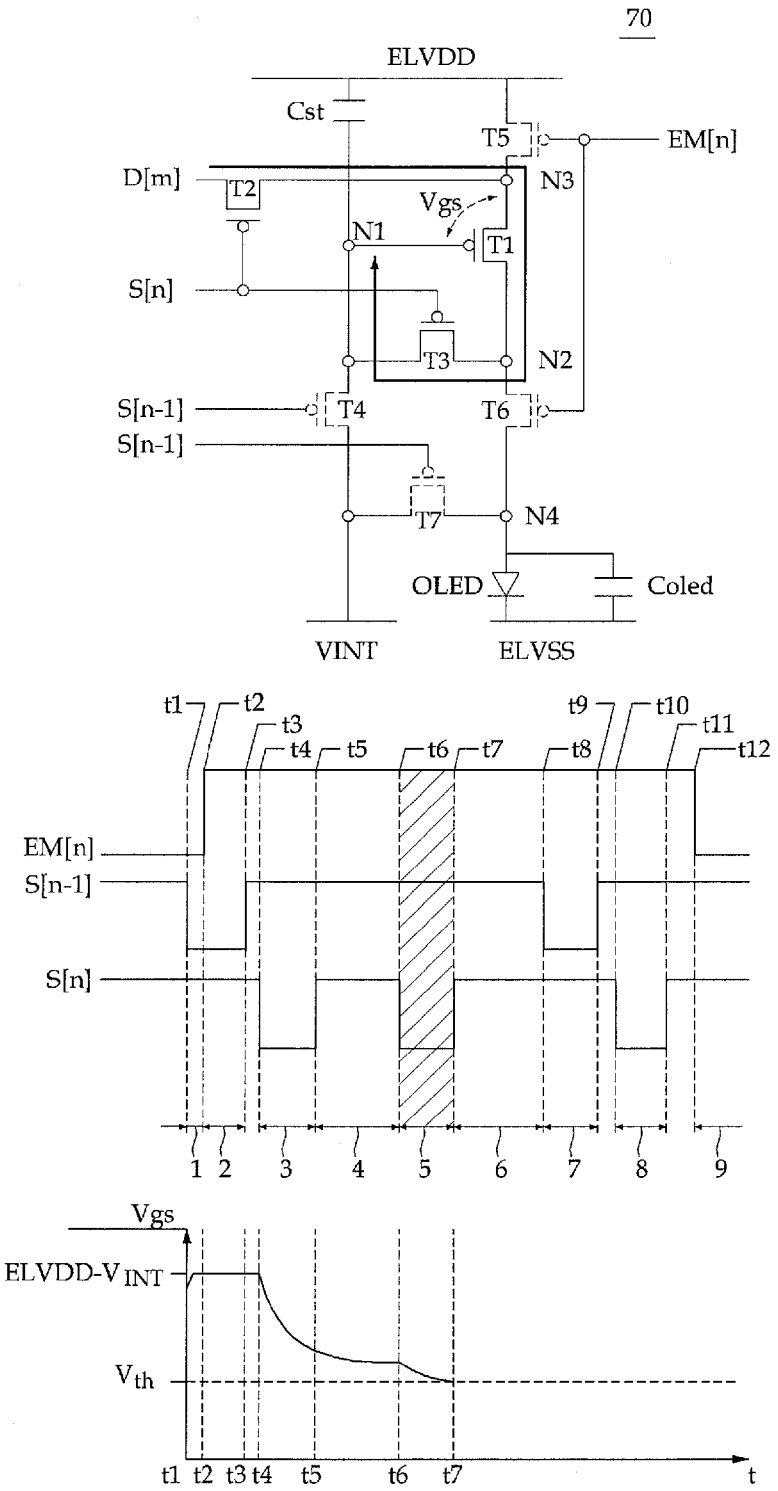

As shown in FIG. 4E, the first scan signal having the low voltage is applied to the first scan line Sn during a fifth period 5.

Then, the second and third transistors T2 and T3 are turned on, and the first transistor T1 is diode coupled by the third transistor T3.

During the fifth period 5, a second data signal is applied to the data line Dm, and the second data signal is transmitted to the first node N1 via the second transistor T2, the first transistor T1, and the third transistor T3. In this configuration, the first transistor T1 is in the diode-coupled state, so that the different voltage between a second data voltage applied by the second data signal and the threshold voltage Vth of the first transistor T1 is applied to the first node N1. The voltage transmitted to the first node N1 during the fifth period 5 is stored in the capacitor Cst.

The second data voltage applied by the second data signal is not a present data voltage but a previous data voltage. The previous data voltage may be a data voltage immediately before the present data voltage, or a data voltage prior to the four lines. That is, the data voltage enables the gate-source voltage Vgs of the first transistor T1 to be lowered near the threshold voltage Vth.

The fifth period 5 is a period for further lowering the gate-source voltage Vgs of the first transistor T1 while having the same operation of the transistors as that of the third period 3. Therefore, the second data voltage applied during the fifth period 5 is lower than the first data voltage applied during the third period 3. For instance, the gate-source voltage Vgs of the first transistor T1 is lowered by a level of the threshold voltage Vth during the fifth period 5.

Accordingly, during the fifth period 5, the gate-source voltage Vgs of the first transistor T1 may be the on-bias voltage or off-bias voltage. In other words, the gate-source voltage Vgs of the first transistor T1 may be slightly higher or lower than the threshold voltage Vth. For instance, the gate-source voltage Vgs of the first transistor T1 may range from about Vth−3V to about Vht+3V.

That is, the gate-source voltage Vgs of the first transistor T1 is formed near the threshold voltage Vth.

Referring to the graph of FIG. 4E, the gate-source voltage Vgs of the first transistor T1 maintained during the fourth period 4 is lowered to the threshold voltage Vth of the first transistor T1 from t6 to t7.

Figure 4F:
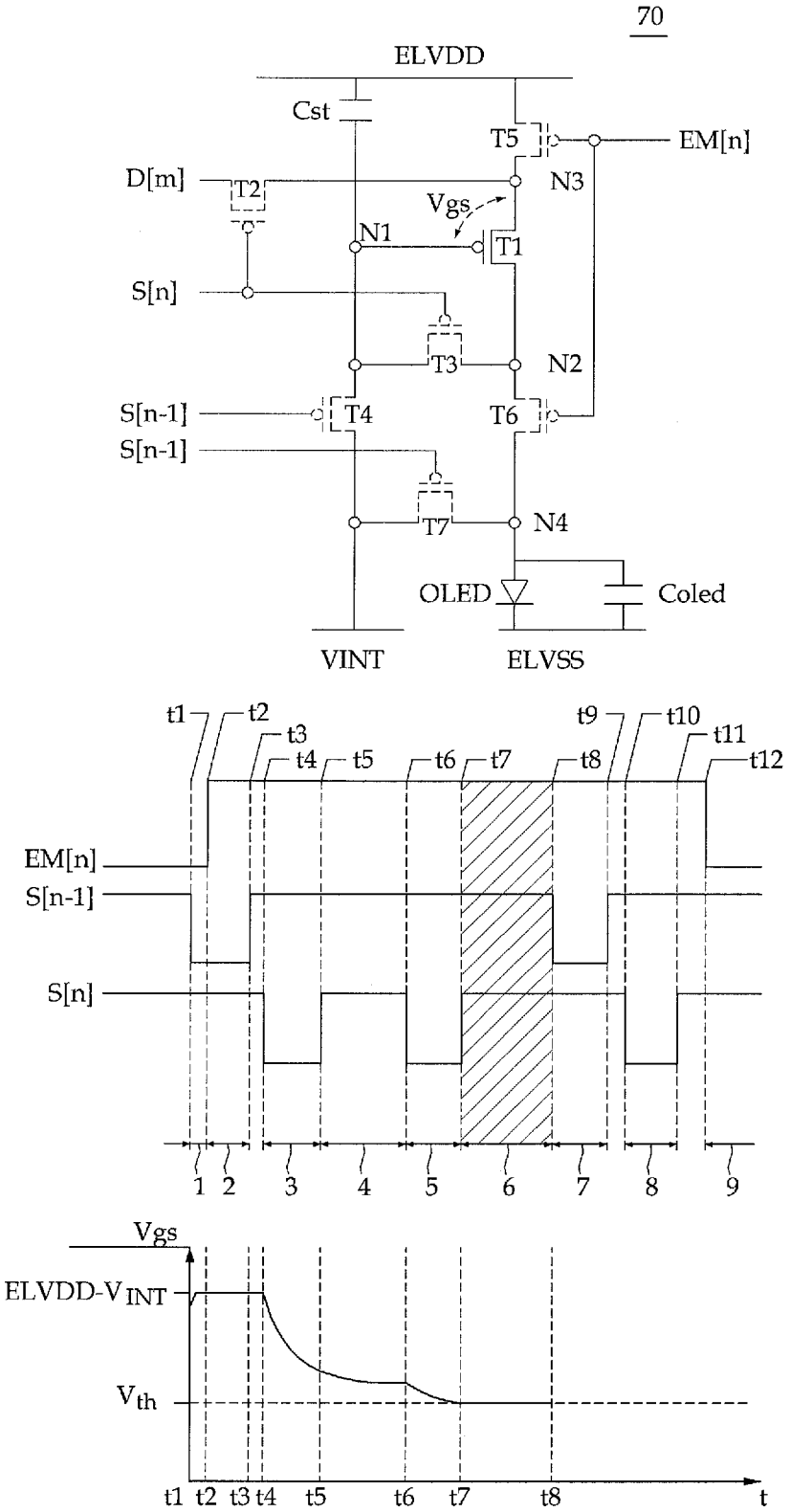

As shown in FIG. 4F, the scan signal having the high voltage is applied to the first and second scan lines Sn and Sn−1 during a sixth period 6 so that all of the transistors T2 to T7 are turned off except for the first transistor T1.

The gate and source electrodes of the first transistor T1 is floating during the sixth period 6. Thus, referring to the graph of FIG. 4F, the gate-source voltage Vgs of the first transistor T1 is maintained as the voltage formed during the fifth period 5 from t7 to t8.

Figure 4G:
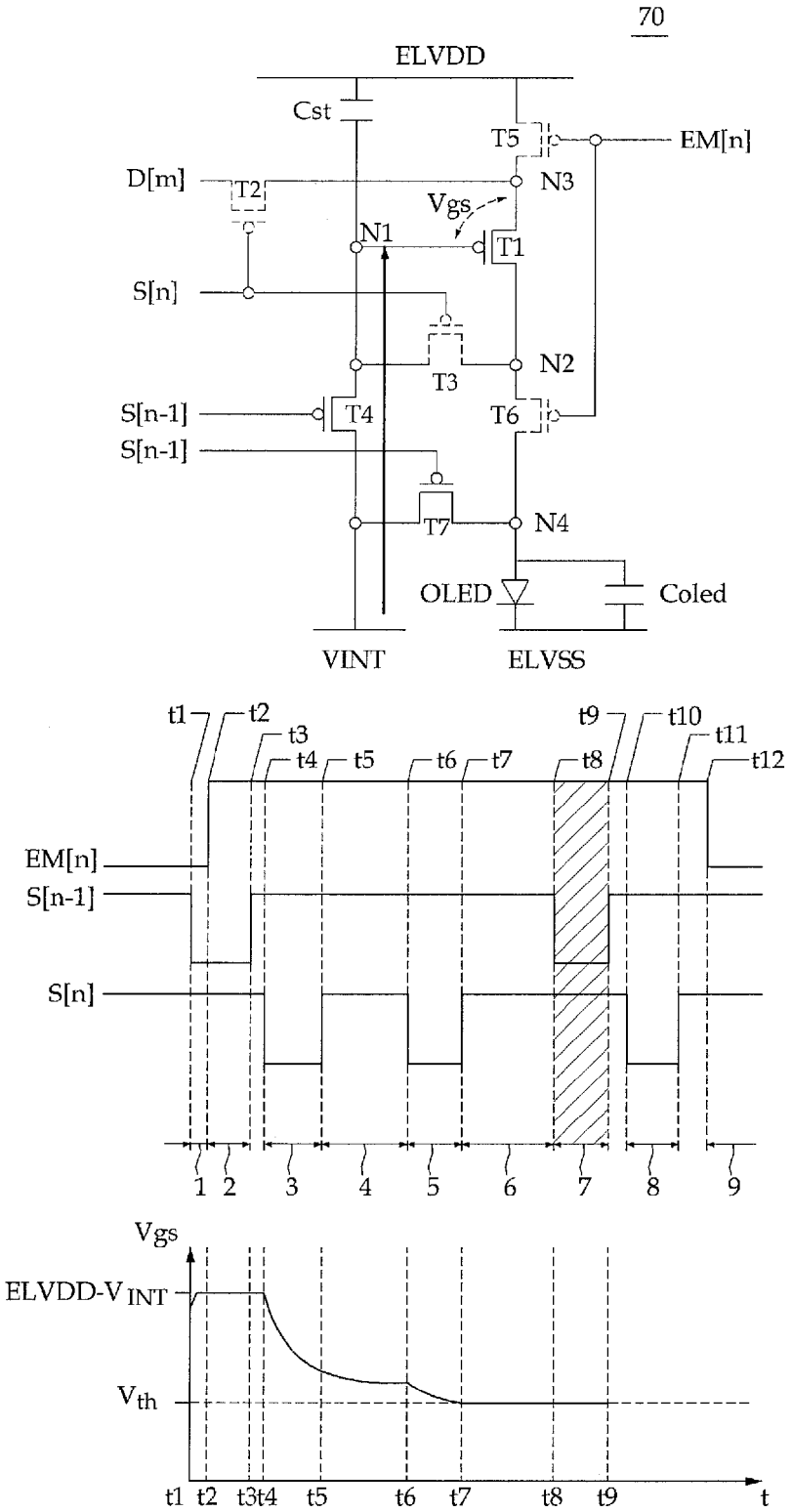

Referring to FIG. 4G, the second scan signal is applied to the second scan line Sn−1 during a seventh period 7.

In the case where the second scan signal having the low voltage is applied to the second scan line Sn−1, the fourth transistor T4 is turned on such that the third power source voltage VINT is transmitted to the first node N1 (the arrow direction of FIG. 4G is illustrated by considering that the voltage of the first node N1 may be set to be equal to or less than the third power source voltage VINT before the seventh period 7).

Herein, the third power source voltage VINT may be set to be low enough to initialize the first node N1. For example, the third power source voltage VINT may range from about −5 V to about 0 V. Therefore, the first transistor T1 may be diode coupled in a forward direction by the third power source voltage VINT during the following eighth period 8 so that the present data signal may be stably transmitted to the first node N1 via the first transistor T1 and the third transistor T3.

The third power source voltage VINT is set to the low voltage, and the first transistor T1 is also turned on during the seventh period 7 in which the second scan signal is applied to the second scan line Sn−1.

The fourth transistor T4 is maintained in the turn-on state during the seventh period 7, and thus the first node N1 is stably supplied with the third power source voltage VINT.

The third power source voltage VINT, which is the same as that of the first period 1, may be applied to the first node N1 during the seventh period 7, and the source electrode of the first transistor T1 is floating. Therefore, referring to the graph of FIG. 4G, the gate-source voltage Vgs of the first transistor T1 is the same as the voltage at t8, which is formed during the sixth period 6, and is maintained from t8 to t9.

The seventh period 7 shown in FIG. 4G is a period for initializing the voltage stored in the capacitor Cst coupled to the first node N1. Therefore, the seventh period 7 is a period in which the voltage of the capacitor Cst is initialized, and the internal capacitance of the first transistor T1 is not initialized and maintains the gate-source voltage Vgs formed during the sixth period 6. This is because the capacitor Cst is coupled between the third power source voltage VINT and the first power source voltage ELVDD, while the source electrode of the first transistor T1 is floating.

Figure 4H:
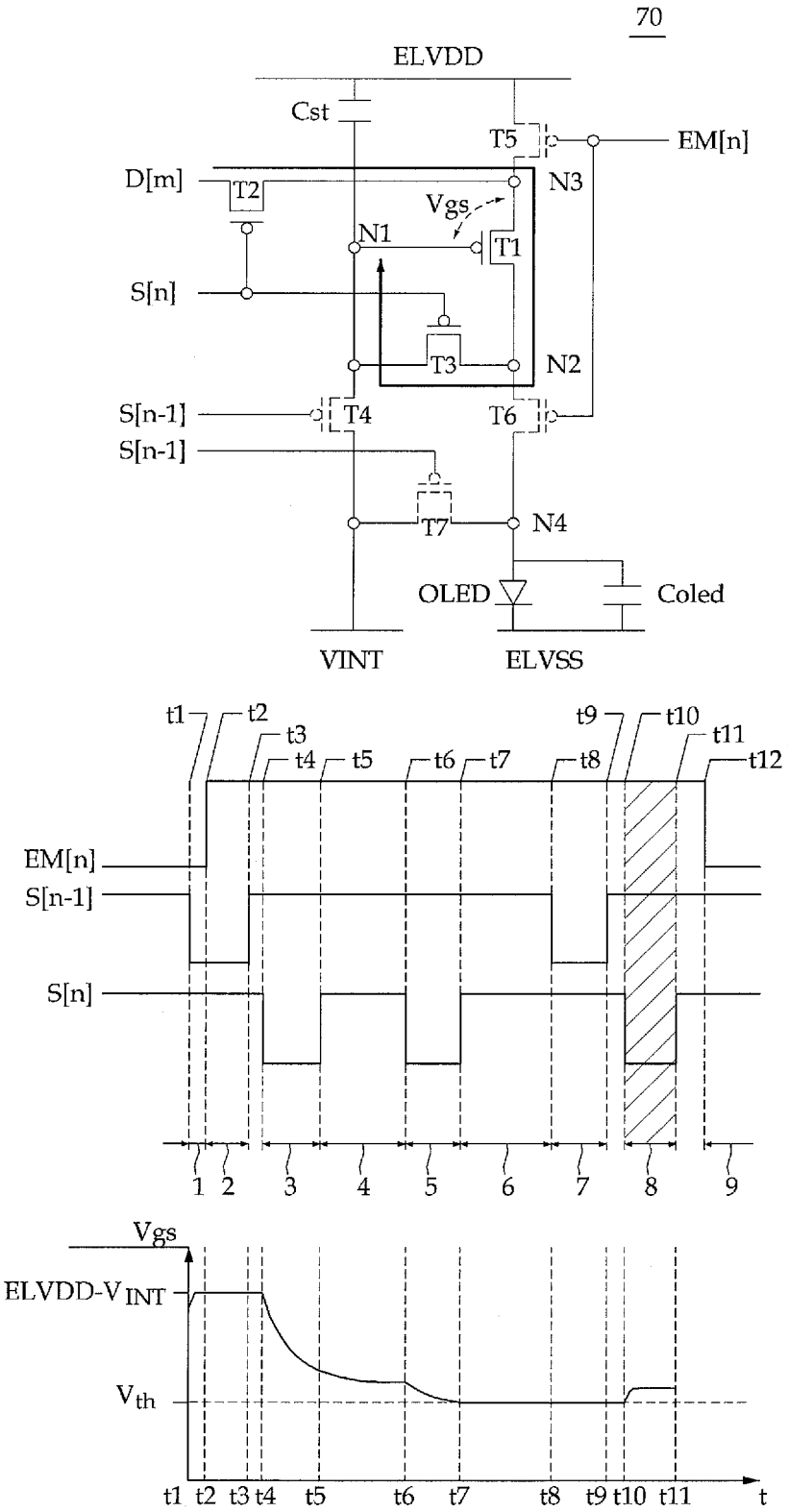

As shown in FIG. 4H, the first scan signal having the low voltage is applied to the first scan line Sn during the eighth period 8.

Then, the second and third transistors T2 and T3 are turned on, and the first transistor T1 is diode coupled by the third transistor T3.

During the eighth period 8, the present data signal is applied to the data line Dm, and the present data signal is transmitted to the first node N1 via the second transistor T2, the first transistor T1, and the third transistor T3. In this configuration, the first transistor T1 is in the diode-coupled state, so that the different voltage between the present data voltage applied by the present data signal and the threshold voltage Vth of the first transistor T1 is delivered to the first node N1.

In other words, the eighth period 8 is a data programming and threshold voltage compensation period in which the first node N1 is supplied with voltage corresponding to the present data signal and the threshold voltage Vth of the first transistor T1, and the voltage transmitted to the first node N1 during the eighth period 8 is stored in the capacitor Cst.

Referring to the graph of FIG. 4H, the gate-source voltage Vgs reflecting the present data voltage applied during the eighth period 8 is slightly higher than the threshold voltage Vth from t10 to t11. That is, the on-bias voltage Vgs between the gate and source electrodes of the first transistor T1 is formed during the eighth period 8.

The present data voltage corresponds to the mid gray level. Thus, there is not much change in the gate-source voltage Vgs of the first transistor T1 even though the voltage corresponding to the mid gray level is applied during the third period 3 to the sixth period 6. In other words, in the case where driving transistors of all pixels are initialized as described above when the mid gray level is displayed, smear is reduced (e.g., prevented), and further description thereof will be provided below with reference to FIG. 5.

Figure 4I:
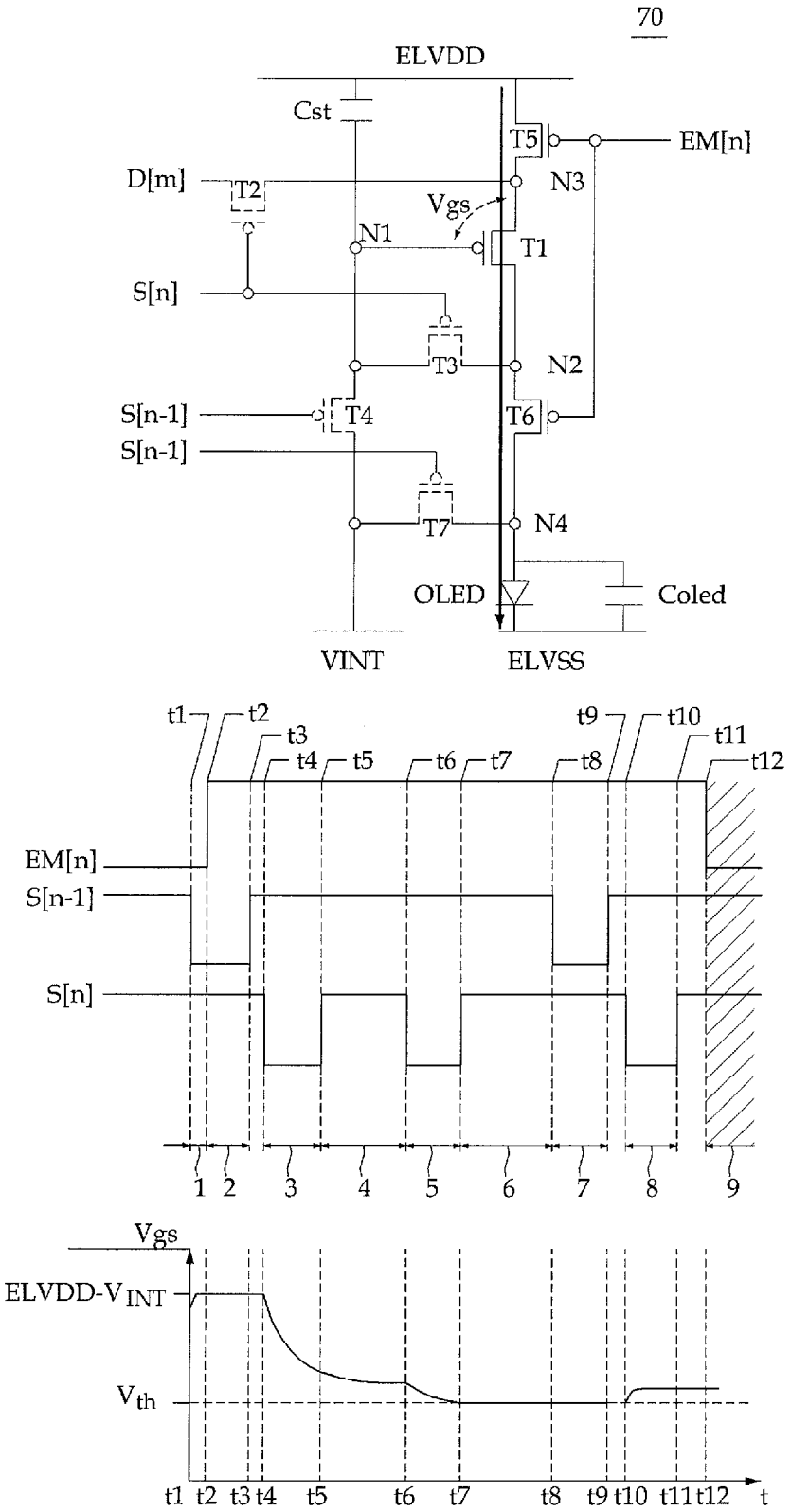

As shown in FIG. 4I, the light emission control signal having the low voltage is applied to the light emission control line EMn during a ninth period 9 after the completion of the supply of the first scan signal to the first scan line Sn.

Accordingly, the fifth and sixth transistors T5 and T6 are turned on so that the driving current I1 flows into the second power source voltage ELVSS via the fifth transistor T5, the first transistor T1, the sixth transistor T6, and the OLED, from the first power source voltage ELVDD.

In this configuration, the driving current I1 is controlled by the first transistor T1 corresponding to the voltage of the first node N1, and the voltage equivalent to the threshold voltage Vth of the first transistor T1 is stored together with the voltage of the present data signal in the first node N1 during the previous eighth period 8, so that the threshold voltage of the first transistor T1 is offset during the eighth period 8, and then is uniformly set corresponding to the present data signal regardless of the variation of the threshold voltage of the first transistor T1.

In other words, the ninth period 9 is a light emission period of the pixel 70, and the OLED emits light of which luminance corresponds to the data signal during the ninth period 9.

Hereinafter, an effect on reducing (e.g., preventing) the smear will be described with reference to FIG. 5.

Figure 5:
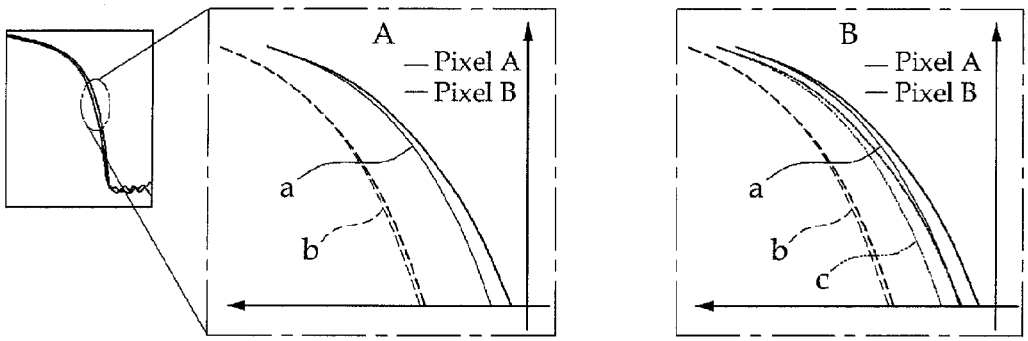
FIG. 5 is a diagram showing improved response characteristics of a first transistor according to the driving operation shown in FIG. 3.

FIG. 5 is a diagram showing improved response characteristics of the first transistor according to the driving operation shown in FIG. 3.

The third period 3 to the sixth period 6 will be called a smear reduction period (e.g., a smear prevention period), and the effect thereof will be described below.

The problem of lowering the response characteristics of the conventional display device results from the properties of the driving transistor included in the pixel. In other words, the threshold voltage of the driving transistor is shifted to correspond to the voltage applied to the driving transistor during the previous frame period, and due to the shifted threshold voltage, light with desired luminance may not be generated during the current frame period. The response characteristics are further lowered, in particular, when the black is changed to the white.

Therefore, the on-bias voltage is applied to the driving transistor before the voltage corresponding to the data signal is stored in the storage capacitor. In the case where the on-bias voltage is applied to the driving transistor, a characteristic curve (or threshold voltage) of the driving transistor is initialized, in a predetermined state. In other words, the driving transistor included in each pixel is initialized in a state of displaying the white.

As described above, the problem of reduction of the response characteristics is solved by applying the driving method using the on-bias voltage, but the characteristic curve (or threshold voltage) of the driving transistor is shifted to the left side compared to that of the driving transistor which is not applied with the on-bias voltage because the driving transistor is initialized in the state of displaying the white.

The characteristic curve (or threshold voltage) of the driving transistor, which is shifted to the left side, will be described below with reference to the diagram A shown in FIG. 5.

Referring to FIG. 5, the diagram A shows an effect in the case where the existing first, seventh, and eighth periods 1, 7, and 8 are only applied. The curves a and b of the diagram A is an enlarged part of the curves of the response characteristics of the driving transistor. The curve a is a response characteristic curve of the driving transistor in the case where the voltage corresponding to the mid gray level display is applied to the data voltage. The curve b is a response characteristic curve of the driving transistor reflecting the on-bias voltage applied to reduce (e.g., prevent) the delay of the response time.

As a result of the shift, in the case where the existing threshold voltage compensation period is also applied, smear occurs when the mid gray level is displayed on the screen.

In other words, there is a problem of the smear appearing in a specific gradation because the characteristic curve of the driving transistor is changed by the application of the on-bias voltage. The specific gradation in which the smear often appears is usually the mid gray level.

According to an embodiment of the present invention, the smear reduction period (e.g., smear prevention period) is further included after the period in which the on-bias voltage is applied to the first transistor T1 that is the driving transistor.

In the case of further including the smear reduction period, the characteristic curve of the first transistor T1, which is the driving transistor, is initialized in a predetermined state. That is, the first transistor T1 included in each pixel is initialized in a state of displaying the mid gray level.

Referring to FIG. 5, the diagram B shows an effect in the case where the smear reduction period (the third period 3 to the sixth period 6) is applied. The curves a, b, and c of the diagram B is an enlarged part of the curves of the response characteristics of the driving transistor. The curves a and b are the same as those of the diagram A. The curve c is a response characteristic curve of the driving transistor reflecting the smear reduction period.

In other words, the first transistor T1 is initialized to display the mid gray level as in the characteristic curve shown in the diagram B of FIG. 5, light having the same luminance is generated by all of the pixels when the mid gray level is displayed, and accordingly an image with uniform luminance may be displayed. That is, the smear occurring when the mid gray level is displayed, is reduced (e.g., prevented).

The transistor operation of the fifth period 5 and the sixth period 6 is identical to that of the third period 3 and the fourth period 4. The fifth period 5 and the sixth period 6 are further included to lower the gate-source voltage Vgs of the first transistor T1 once more.

This embodiment of the present invention is applied in the case where the data voltage corresponding to the mid gray level in which the smear is clearly visible is similar to the threshold voltage Vth of the first transistor T1. In general, the data voltage corresponding to the mid gray level is similar to the threshold voltage of a general transistor. Therefore, in the event that the gate-source voltage Vgs of the first transistor T1 is set near the threshold voltage Vth, the smear appearing when the mid gray level is displayed may be reduced (e.g., prevented). That is, the third period 3 to the sixth period 6 becomes the period in which the smear appearing when the mid gray level is displayed is reduced (e.g., prevented).

Hereinafter, another embodiment and yet another embodiment of the present invention will be provided with reference to FIGS. 6 and 7.

Figure 6:
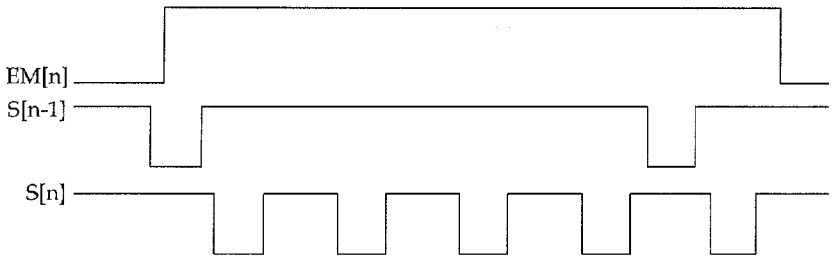
FIG. 6 is a timing diagram illustrating a driving operation of a pixel according to another embodiment of the present invention.

FIG. 6 is a timing diagram illustrating a driving operation of a pixel according to another embodiment of the present invention. FIG. 7 is a timing diagram illustrating a driving operation of a pixel according to yet another embodiment of the present invention.

In an embodiment of the present invention, the gradation where the smear often occurs is assumed as the mid gray level in the driving method in which the on-bias voltage is applied. Thus, grayscale voltage in which the smear occurs when the on-bias voltage is applied may vary depending on display devices.

As shown in FIG. 6, according to another embodiment of the present invention, the gate-source voltage Vgs of the driving transistor is changed to the grayscale voltage in which the smear occurs easily by adjusting the number of the smear reduction periods.

Figure 7:
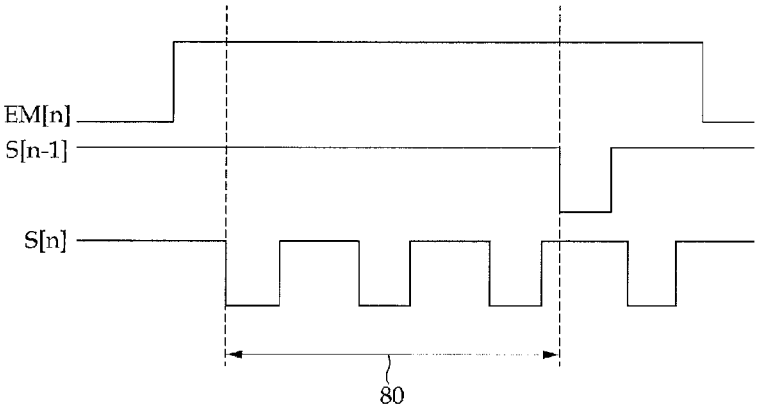
FIG. 7 is a timing diagram illustrating a driving operation of a pixel according to yet another embodiment of the present invention.

As shown in FIG. 7, according to yet another embodiment of the present invention, the smear reduction period is applied to a display device using the driving method in which the on-bias voltage is not applied.

In other words, even though the on-bias voltage is not applied, the smear may appear when the mid gray level is displayed in each display device, and thus the smear resulting from the gray level may be reduced (e.g., prevented) by using the driving method including the smear reduction period 80.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims, and equivalents thereof.

What is claimed is:

1. A method of driving a display device comprising a plurality of pixels, wherein each of the pixels comprises: an organic light emitting diode (OLED) between a first power source and a second power source; a first transistor configured to transmit a driving current corresponding to a data signal to the OLED; a second transistor configured to couple a first electrode of the first transistor to a data line in response to a first scan signal; a third transistor configured to diode-couple the first transistor in response to the first scan signal; a fourth transistor configured to transmit voltage of a third power source to a gate electrode of the first transistor in response to a second scan signal; a fifth transistor configured to control light emission of the OLED in response to a light emission control signal; and a capacitor between the first power source and the first transistor, the method comprising:

applying a first voltage at the first transistor to turn on the first transistor;

maintaining the first voltage at the first transistor;

applying a second voltage lower than the first voltage at the first transistor; and maintaining the second voltage at the first transistor, wherein the applying of the first voltage comprises switching the fourth transistor according to the second scan signal to couple the gate electrode of the first transistor to the third power source, and switching the fifth transistor according to the light emission control signal to couple the first electrode of the first transistor to the first power source, wherein the applying of the second voltage comprises switching the second transistor according to the first scan signal to couple the first electrode of the first transistor to the data line, and switching the third transistor according to the first scan signal to diode-couple the first transistor, and wherein the applying of the second voltage and the maintaining of the second voltage are performed at least twice between consecutive applications of the first voltage.

2. The method of claim 1, wherein the first scan signal is transmitted to a first scan line, and the second scan signal is transmitted to a second scan line prior to the transmission of the first scan signal.

3. The method of claim 1, wherein the maintaining of the first and second voltages float the first electrode of the first transistor.

4. The method of claim 1, wherein the display device further comprises a seventh transistor between the OLED and the third power source, wherein a gate electrode of the seventh transistor is coupled to a second scan line and the seventh transistor is turned on during the applying of the first voltage and the maintaining of the first voltage.

5. The method of claim 1, wherein the display device further comprises a sixth transistor configured to control light emission of the OLED.

6. The method of claim 1, further comprising:

initializing a gate electrode voltage of the first transistor;

compensating for a threshold voltage of the first transistor and transmitting the data signal to the first transistor through the data line coupled to the first transistor; and providing the driving current to the OLED according to the data signal to produce light emission.

7. The method of claim 6, wherein the initializing of the gate electrode voltage of the first transistor comprises switching the fourth transistor according to the second scan signal to supply voltage of the third power source to the gate electrode of the first transistor.

8. The method of claim 6, wherein the compensating for the threshold voltage of the first transistor and the transmitting of the data signal to the first transistor comprise switching the second transistor according to the first scan signal to couple the first transistor and the data line, and switching the third transistor according to the first scan signal to diode couple the first transistor.

9. The method of claim 6, wherein the providing of the driving current to the OLED according to the data signal to produce light emission comprises controlling the light emission of the OLED by the fifth transistor between the first power source and the OLED and is operated by the light emission control signal.

10. A method of driving a display device comprising a plurality of pixels, wherein each of the plurality of pixels comprises: an OLED between a first power source and a second power source; a first transistor between the first power source and the OLED, a gate electrode of the first transistor being coupled to a first node; a second transistor between a first electrode of the first transistor coupled to the first power source and a data line, the gate electrode of the second transistor being coupled to a first scan line; a third transistor between a second electrode of the first transistor coupled to the OLED and the first node, the gate electrode of the third transistor being coupled to the first scan line; a fourth transistor between a third power source and the first node, the gate electrode of the fourth transistor being coupled to a second scan line; a fifth transistor between the first power source and the OLED, the gate electrode of the fifth transistor being coupled to a light emission control line; and a capacitor between the first power source and the first node, the method comprising:

applying a first voltage at the first transistor to turn on the first transistor;

maintaining the first voltage at the first transistor;

applying a second voltage lower than the first voltage at the first transistor; and maintaining the second voltage at the first transistor, wherein the applying of the first voltage comprises switching the fourth transistor according to a second scan signal to couple the gate electrode of the first transistor to the third power source, and switching the fifth transistor according to a light emission control signal to couple the first electrode of the first transistor to the first power source, wherein the applying of the second voltage comprises switching the second transistor according to a first scan signal to couple the first electrode of the first transistor to the data line, and switching the third transistor according to the first scan signal to diode-couple the first transistor, and wherein the applying of the second voltage and the maintaining of the second voltage are performed at least twice between consecutive applications of the first voltage.

* * * * *